US005741195A

United States Patent [19]

Sullivan et al.

[11] Patent Number: 5,741,195

[45] Date of Patent: Apr. 21, 1998

[54] HIGH VISIBILITY INFLATED GAME BALL

[75] Inventors: Michael J. Sullivan, Chicopee; R. Dennis Nesbitt, Westfield, both of Mass.

[73] Assignee: Lisco, Inc., Tampa, Fla.

[21] Appl. No.: 561,792

[22] Filed: Nov. 22, 1995

Related U.S. Application Data

[63] Continuation-in-part of Ser. No. 316,699, Sep. 30, 1994, Pat. No. 5,470,058.

[51] Int. Cl.[6] ..... A63B 41/02; A63B 41/08; A63B 43/06

[52] U.S. Cl. ..... 473/570; 473/599; 473/603; 473/605

[58] Field of Search ..... 273/DIG. 24; 473/598, 473/599, 600, 601, 602, 603, 604, 605, 607, 148, 153, 570

[56] References Cited

U.S. PATENT DOCUMENTS

| | | | |
|---|---|---|---|
| 2,924,593 | 2/1960 | Breslow | 260/94.9 |
| 3,207,514 | 9/1965 | Vickery | 273/63 |
| 3,458,205 | 7/1969 | Smith et al. | 273/213 |
| 3,491,073 | 1/1970 | Marinak | 260/80.78 |
| 3,645,992 | 2/1972 | Elston | 260/80.78 |
| 4,116,439 | 9/1978 | Chavarria et al. | 273/59 A |
| 4,205,021 | 5/1980 | Morita et al. | 525/240 |
| 4,405,774 | 9/1983 | Miwa et al. | 526/348.2 |
| 4,510,303 | 4/1985 | Oda et al. | 526/282 |
| 4,530,914 | 7/1985 | Ewen et al. | 502/113 |
| 4,668,752 | 5/1987 | Tominari et al. | 526/348.2 |
| 4,679,795 | 7/1987 | Melvin et al. | 273/235 R |
| 4,798,386 | 1/1989 | Berard | 273/235 R |
| 4,808,561 | 2/1989 | Welborn, Jr. | 502/104 |
| 4,867,452 | 9/1989 | Finley | 273/65 E |
| 4,935,474 | 6/1990 | Ewen et al. | 526/114 |
| 4,937,299 | 6/1990 | Ewen et al. | 526/119 |
| 4,987,212 | 1/1991 | Morterol et al. | 526/348.4 |
| 5,026,798 | 6/1991 | Canich | 526/127 |
| 5,055,438 | 10/1991 | Canich | 502/117 |
| 5,084,540 | 1/1992 | Albizzati et al. | 526/348.6 |
| 5,084,802 | 1/1992 | Stevens et al. | 502/155 |
| 5,091,265 | 2/1992 | Kennedy et al. | 428/690 |
| 5,123,659 | 6/1992 | Williams | 273/60 B |
| 5,181,717 | 1/1993 | Donntag et al. | 273/58 BA |
| 5,246,783 | 9/1993 | Spenadel et al. | 428/461 |
| 5,251,337 | 10/1993 | Sloot | 2/243.1 |
| 5,272,016 | 12/1993 | Ralph | 428/516 |
| 5,272,236 | 12/1993 | Lai et al. | 526/348.5 |
| 5,278,272 | 1/1994 | Lai et al. | 526/348.5 |
| 5,320,345 | 6/1994 | Lai et al. | 273/58 R |
| 5,324,800 | 6/1994 | Welborn, Jr. et al. | 526/160 |
| 5,415,905 | 5/1995 | Middlesworth et al. | 528/35.7 |

FOREIGN PATENT DOCUMENTS

| | | |
|---|---|---|
| 0 210 615 A2 | 2/1987 | European Pat. Off. . |
| 0 351 392 A2 | 1/1990 | European Pat. Off. . |
| 26 08 863 A1 | 9/1977 | Germany . |
| 3835044 A1 | 4/1990 | Germany . |

OTHER PUBLICATIONS

"A New Family of Resins", Converting Magazine Sep. 1993 and Oct. 1993.

"Competition for Metallocenes Could Turn Ugly", Plastics World, Jan. 1995.

"Selected Applications for Constrained Geometry Catalyst Technology (CGCT) Polymers", G.D. Schwank, Dow Chemical, U.S.A., Sep. 23, 1992.

ENGAGE Polyolefin Elastomers, Dow Plastics.

EXACT™ Plastomers, Targeted Performance for Extrusion, Molding and Polymer Modification, EXXON Chem. Co., 1994.

EXACT™ Plastomers, Fact Sheet—Highly Gas Permeable Films, EXXON Chem. Co.

"A New Family of Linear Ethylene Polymers", EXXON Chem. Co., 1993.

"Here's the Latest Score on Single–Site Catalysts", Plastics World, Apr. 1996.

"A New Family of Linear Ethylene Polymers with Enhanced Sealing Performance", EXXON Chem. Co.

EXXPOL™ Technology—Single Site Catalyzed Polymerization Technology, EXXON Chem. Co.

"Environmentally Friendly Films", EXXON Chem. Co., 1993.

"Products from EXXPOL™ Technology", EXXON Chem. Co., (47 pp.), 1992—1995.

"Polyolefin Modification with EXACT™ Plastomers", EXXON Chem. Co.

"EXACT™ 4049", EXXON Chem. Co., Oct. 1994.

"EXACT FACTS™", EXXON Chem. Co., Jun. 1994.

"ENGAGE Polyolefin ELastomers", DOW Plastics, DOW Chem. Co.

"Performance of Ethylene/1–Octane, Ethylene/1–Pentene and Ethylene/1–Butene Elastomers Made Using INSITE™ Technology in Peroxide–Cured Durable Formulations", Dow Chem. Co., Oct. 1995.

"New Hydrocarbon Elastomers vai Constained Geometry Catalyst Technology", Dow Chem. Co., Oct. 1995.

*Primary Examiner*—Thomas R. Weber

[57] ABSTRACT

A hgh-visbility inflated game ball such as a basketball, football, soccer ball, volleyball or the like. The game ball includes a central inflated portion and a metallocene catalyzed polyolefin cover formed over the central inflated portion. In one embodiment, the cover has fluorescent pigment, fluorescent dye, and/or optical brighteners incorporated therein in order to impart to the cover a reflectance of at least 75% in at least a part of the visible spectrum. In another embodiment, reflective metallic particles are incorporated in addition to, or in place of the pigment, dye and optical brightener in order to add a glittery appearance to the ball cover. The particularly preferred game ball of the invention is a basketball. The game ball is particularly useful at dusk when conventional basketballs of a dull orange color become difficult to see.

23 Claims, 6 Drawing Sheets

HIGH VISIBILITY INFLATED GAME BALL

RELATED APPLICATIONS

This is a continuation-in-part of U.S. application Ser. No. 08/316,699, filed on Sep. 30, 1994, which issued as U.S. Pat. No. 5,470,058 Nov. 28, 1995.

FIELD OF THE INVENTION

The present invention relates generally to inflated game balls, and more particularly to inflated game balls with metallocene catalyzed polyolefin covers having enhanced visibility.

BACKGROUND OF THE INVENTION

A conventional inflated game ball has a central inflated black rubber bladder which is covered by a winding of natural or synthetic filaments. As an alternative to a wound bladder, a durable, synthetic non-wound carcass can be employed which is molded from a polymeric material. The carcass or wound bladder is covered with a leather or rubber cover formed from natural or synthetic materials.

Rubber covers for basketballs typically are formed from orange tinted styrene butadiene rubber or natural rubber, both of which are sulfur cured materials. These rubber covers are opaque, and the orange color of the balls is rather dull as a result of the sulfur curing. Thus, basketballs of this type have limited visibility at dusk, and therefore are disadvantageous in that a difficulty in accurately perceiving the exact location and/or speed of the ball in flight can result in injury to a player, particularly at an advanced level of play.

Vinyl basketballs have been produced which have substantially brighter coloring than the synthetic or natural rubber covered basketballs. However, vinyl basketballs are inferior to rubber basketballs in gripability or tackiness as well as scuff resistance, and therefore are considered to be of lower quality.

SUMMARY OF THE INVENTION

An object of the invention is to provide a high visibility inflated game ball.

Another object of the invention is to provide an inflated game ball with the safety feature that it is more readily visible at dusk than a conventional game ball.

Yet another object of the invention is to provide a high visibility game ball of superior quality.

Yet another object of the invention is to provide a basketball having a reduced likelihood of causing injury during use after sunset.

A further object of the invention is to provide a method of forming a game ball having the features described above.

Other objects of the invention will be in part obvious and in part pointed out more in detail hereinafter.

The invention in a preferred form is a high visibility game ball comprising a central inflated portion and a cover formed over the central inflated portion. The cover is formed from a cover material comprising a metallocene catalyzed polyolefin. Preferably, the metallocene catalyzed polyolefin is cross-linked. The cover material includes at least one visibility enhancing agent selected from the group consisting of reflective particles having faces with a reflectance of at least 75% and a tinting agent with imparts to at least a portion of said game ball a reflectance of at least 75% in a part of the visible spectrum. In a particularly preferred form of the invention in which a tinting agent is used, the tinting agent imparts to at least a portion of the game ball a reflectance of at least 85%, and most preferably over 100% in a part of the visible spectrum.

Throughout this application, reflectance is to be understood as being based upon ASTM E-313-73.

In addition to a metallocene catalyzed polyolefin, the cover material may include other materials, non-limiting examples of which include a terpolymer elastomer made from ethylene propylene diene monomer (EPDM), ethylene propylene rubber (EPR), natural rubber or a blend of EPDM with polyisoprene and/or polybutadiene rubbers.

In a particularly preferred form of the invention, the tinting agent includes at least one member selected from the group consisting of fluorescent dyes, fluorescent pigments and optical brighteners. The tinting agent is added to the cover material mixture in an amount sufficient to provide the desired degree of enhanced visibility. Typically, an optical brightener is added to the cover material in an amount of about 0.01–2.0 parts by weight, a fluorescent pigment is added in an amount of about 0.1–5.0 parts by weight, and a fluorescent dye is included in an amount of about 0.01–2.0 parts by weight, each being based upon 100 total parts by weight of metallocene catalyzed polyolefin and rubber. In a particularly preferred form of the invention, the fluorescent materials can provide the ball with twice the reflectance as would result from the use of a non-fluorescent material providing a non-fluorescent counterpart of generally the same color.

As indicated above, the cover of the game ball is translucent. Thus, in order to provide for excellent reflectance of the cover, the central inflated portion of the ball, which is partially visible through the cover, preferably has a white or light-colored outer surface with a reflectance of at least about 40% in a part of the visible spectrum, and more preferably a reflectance of at least 40% throughout the visible spectrum.

Further preferred forms of the invention are methods of forming high visibility game balls of the types described above.

The invention accordingly consists in the features of construction, combination of elements and arrangement of parts, as well as the several steps which will be exemplified in the construction hereafter set forth and the scope of the application which will be indicated in the appended claims.

DETAILED DESCRIPTION OF THE INVENTION

Figure 1:
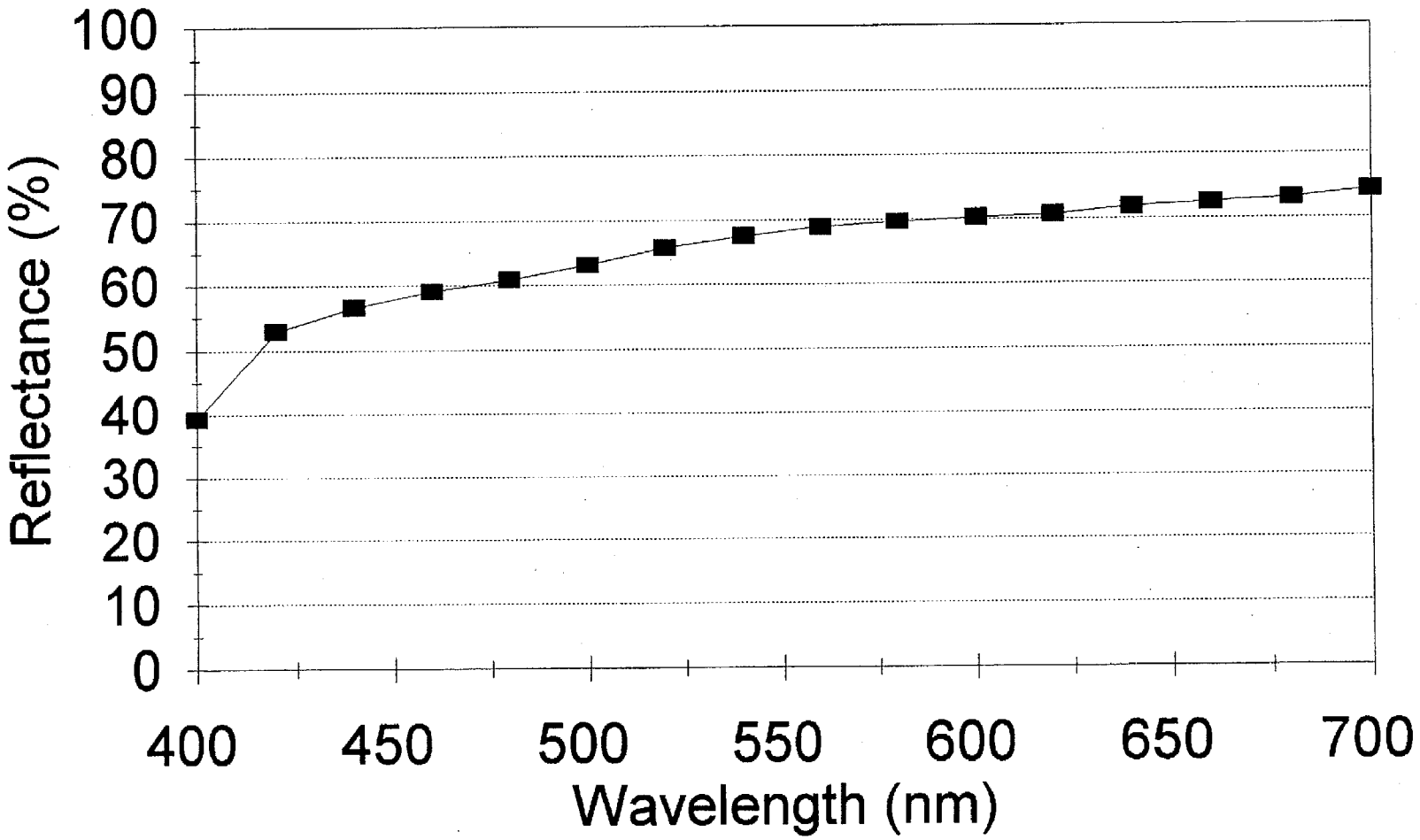
FIG. 1 is a graph showing the reflectance of the bladder which is used in the fluorescent basketballs of examples 1–6 of the present invention.

The game ball of the invention can be a basketball, football, volleyball, soccer ball, or other type of inflated ball with a thermoset cover. In the most preferred form, the game ball constitutes a basketball.

The cover of the game ball is visually enhanced through the incorporation. of fluorescent materials, optical brighteners, or highly reflective particles. The game ball is not a glow-in-the-dark ball, and therefore it is not necessary to place the ball beneath a bright light before it exhibits properties of enhanced visibility. Furthermore, the cover is not illuminated by a power source such as a battery. The cover on the high visibility game ball preferably is translucent.

The present invention also includes game balls having thermochromatic and photochromatic covers with enhanced visibility. Such covers are formed by adding thermochromatic or photochromatic materials to the uncured cover material.

The central inflated portion of the game ball can be of conventional construction. Bladders typically are made of butyl rubber, natural rubber, halobutyl rubber blends with synthetic or natural rubber, or in certain cases, urethane. The bladder is wound with an adhesive-coated white or light-colored monofilament polymeric strand, frequently made of nylon or a nylon/polyester blend. For a basketball, about 2100 meters of winding is used. Conventional bladders are colored black. The combination of the black bladder and the light windings imparts a mottled black and white appearance to the outer surface of the central inflated portion. In accordance with the present invention, it is preferable to color the bladder white instead of black, or to provide sufficient windings in order to completely cover any underlying dark surface, thereby imparting to the outer surface of the central inflated portion a light-colored appearance with a reflectance of at least 40% in part or all of the visible spectrum. This construction is particularly advantageous when the cover which is placed over the central inflated portion is highly translucent, as the light color of the central inflated portion then contributes to the reflectance of the cover. It is also noted that the central inflated portion can be made by techniques which do not require windings, but instead have an internal carcass. Furthermore, a wound bladder can be covered with an overlying middle carcass-type layer, such as a middle layer of synthetic or natural rubber which has outwardly-extending ribs in a pattern corresponding to the black lines normally visible on the outer surface of a basketball. When this construction is used, the color of the bladder and windings usually is irrelevant and the middle carcass-type cover preferably is light-colored in order to contribute to the reflectance of the ball.

The cover is formed from a metallocene catalyzed polyolefin which can be blended with material such as EPDM, including metallocene catalyzed EPDM, EPR, or blends of EPDM with polyisoprene and/or polybutadiene rubber. The cover generally contains at least about 10 wt % metallocene catalyzed polyolefin. If the metallocene catalyzed polyolefin is blended with EPDM, the EPDM preferably is present in an amount of, e.g., 50 parts by weight based upon 100 total parts by weight of metallocene catalyzed polyolefin and rubber and more preferably about 25 parts by weight. If the metallocene catalyzed polyolefin is blended with polyisoprene, the polyisoprene is present in an amount of up to about 50 parts by weight based upon 100 parts by weight of metallocene catalyzed polyolefin and polyisoprene and more preferably about 25 parts by weight. In blends of metallocene catalyzed polyolefin and polybutadiene, the polybutadiene is present in an amount of up to about 30 parts by weight and preferably about 10 parts by weight.

If a ball such as a basketball is to have cover panels which are all the same color, the cover can be made by forming two cover halves from a well-blended and calendared mixture of metallocene catalyzed polyolefin, peroxide, and any desired tinting agent such as a fluorescent dye, fluorescent pigment or optical brightener. Reinforcing agents, softening agents, and co-agents can be added in order to enhance the strength and achieve other desired physical properties of the cover material. The cover halves are then vacuum formed around a wound bladder and inflated, and the mold is closed. The uncured ball with a weakly adhered cover is then removed and cured under heat and pressure in a pebbled mold. Black lines are then painted on the ball in a conventional pattern to define the individual panels.

If a game ball such as a basketball is to have panels of different colors, the cover material containing metallocene catalyzed polyolefin, visibility enhancing agent, and, optionally other thermosets, reinforcing agents, softening agents and co-agents, is blended, calendared into sheet form and die cut to panel size. The panels are cold formed to shape around a wound bladder in two halves of a mold.

A multicolored ball according to the invention can have alternating colors on adjacent panels. For purposes of this application, the term "panel" refers to a section of the ball cover which is surrounded by a black outline. Typically, a basketball has eight panels. These panels are final cured in a pebbled mold or the pebbled panels are crosslinked prior to assembly to the carcass.

The metallocene catalyzed polyolefin to be used in the cover material preferably has a pre-cured hardness appropriate to result in a cured cover material with Shore A hardness of about 10–95. If the game ball is a basketball, it is preferred that the Shore A hardness of the cured cover material is no more than about 90. Non-limiting examples of suitable metallocene catalyzed polyolefins that are commercially available include EXACT™ 4049, 4041, 4042, 4033, 3035, 4011, 3024, 3025, 3027, 3028, 3033, 3034, 3022, 4003, and 4006, and ENGAGE EG 8100, EG-8150, EG-8200, and EG-8500, etc. EXACT™ materials are available from Exxon Corp. (Irving, Tex.). Engage™ materials are available from Dow Chemical Company (Midland, Mich.). The most preferred metallocene catalyzed polyolefins are those which have a relatively low Shore hardness to provide for favorable gripping characteristics, combined with good toughness and abrasion resistance.

As indicated above, a suitable synthetic rubber to be blended with a metallocene catalyzed polyolefin in this invention is EPDM (a terpolymer elastomer made from ethylene propylene diene monomer). Several commercially available types of EPDM are Nordel, sold by DuPont (Wilmington, Del.), Polysar EPDM, sold by Bayer, and Vistalon, sold by Exxon Corp. (Irving, Tex.). Because a blend of metallocene catalyzed polyolefin and ethylene propylene diene monomer according to the invention is peroxide cured, rather than sulfur cured, the resulting color of the ball is brighter and has higher visibility than a cover which includes a visibility enhancing agent incorporated into a sulfur-cured rubber. The cover of the game ball of the invention typically has a thickness of about 0.60–3.0 mm, and more preferably 1.5–2.3 mm.

When the cover material is to be peroxide cured, it is preferable to use about 1–5 parts by weight active peroxide (100% peroxide) based upon 100 total parts by weight of metallocene catalyzed polyolefin and rubber. A particularly preferred game ball according to the invention employs 2–4 parts by weight of peroxide based upon 100 total parts by weight of metallocene catalyzed polyolefin and rubber.

When a tinting agent is used, the tinting agent can be any material which enhances the visibility of the ball such that it has a reflectance of at least 75%, preferably at least 85%, and more preferably at least 100% at a range of wavelengths in the visible spectrum. Reflectance values of over 100% can be achieved when fluorescent coloring is used, because the fluorescent material absorbs energy in the ultraviolet region and emits the absorbed energy as fluorescence in the visible region. The wavelengths at which high reflectance occurs will depend upon the color of the basketball at a particular panel. For purposes of this application, the visible spectrum is considered to be in the range of about 400 to about 770 nm. Red objects reflect light primarily in the range of about 622–770 nm. Orange objects have high reflectance in the range of about 597–622 nm. Yellow objects have the highest reflectance in the range of about 570–597 nm. Blue objects have the highest reflectance in the range of about 420–492 nm. The particularly preferred tinting agents are fluorescent dyes, fluorescent pigments and optical brighteners. The fluorescent dyes, fluorescent pigments and optical brighteners are found to increase reflectance within a specific range of wavelengths. Combinations of dyes, pigments and optical brighteners can be used.

If fluorescent dyes are used, the cover generally will have a highly translucent, i.e. nearly transparent, appearance. In one embodiment of the invention, the cover material is clear enough that standard type text is legible through the cover material. If fluorescent pigments and/or powdered optical brighteners are used, the cover will be translucent as long as sufficiently low quantities of these coloring materials are used. In a translucent ball with a metallocene catalyzed polyolefin cover, some of the fluorescent pigment and/or optical brightener which is visible is situated at the outer surface of the cover, other portions of the pigment or brightener which is visible are situated in the middle of the cover, and still other portions are found along the inner surface of the cover. Preferably, the translucence of the cover is such that light can be seen through a sample of the cover material which is not adhered to the ball, but the pigmented cover material preferably is not transparent enough for standard-type text to be legible through the cover material. A reduction in visibility may result if an amount of pigment and/or optical brightener which results in an opaque cover, as compared to a translucent cover, is used, due to the contribution of the bladder to the reflectance of the ball.

When the tinting agent is a pigment which is used alone, it has been found that about 0.1–5.0 parts by weight of pigment preferably are used, and more preferably 1–3 pairs by weight, or optimally 1.5–2.5 parts by weight based upon 100 total parts by weight of the total amount of metallocene catalyzed polyolefin and rubber. Preferably, the pigment is fluorescent orange, yellow, pink or red, or a combination thereof.

The quantities of dye to be used to achieve a particular color are about one-tenth the pigment quantities. Preferably, when used alone, dye is present in an amount of about 0.01–2.0 parts by weight, more preferably 0.075–1.0 parts by weight, and most preferably 0.1–0.50 based upon 100 total parts by weight of metallocene catalyzed polyolefin and rubber. Preferred dye colors are orange, yellow and red, and mixtures thereof. It is noted that pigment and dye can be used in combination. Depending on the type of dye which is used, it may be advantageous to include a thin, clear synthetic finish coating over a dyed cover in order to prevent any bleeding of the dye. Non-limiting examples of suitable coatings are soft polyurethane, epoxy and acrylic materials.

It has been found that in forming a translucent basketball cover having a thickness of about 0.60–3.0 mm, about 0.01–2.0 parts by weight of an optical brightener, when used alone, more preferably 0.075–1.0 parts by weight, and most preferably 0.1–0.5 parts by weight of optical brightener based upon 100 total parts by weight of metallocene catalyzed polyolefin and rubber will increase the reflectance of the ball. Reflectance is found to increase by at least 20% as a result of the addition of optical brightener.

Commonly, small amounts of optical brightener are used in conjunction with a pigment or dye. In this case, the optical brightener preferably is used in an amount of about 0.1–0.5 parts by weight based upon 100 total parts by weight of metallocene catalyzed polyolefin and rubber.

Higher quantities of the dyes, pigments and optical brighteners can be used, however, in most cases the use of larger quantities will not be justified economically because in most cases little benefit in visibility would be obtained from the use of higher quantities.

As an alternative, or in addition, to using fluorescent dyes, fluorescent pigments and optical brighteners to visually enhance the game ball of the invention, highly reflective particles can be dispersed in the cover material as a visibility enhancing agent to produce a game ball with a glittery cover. The particles which are on the outer surface will have a sparkly appearance, while those in the middle and near the inner surface of the cover will have a less sparkly but nevertheless highly reflective appearance. The translucence of the cover material allows for the reflective particles which are not on the outer surface of the cover to be seen. These particles can be used in conjunction with bright red, yellow and orange materials, and also with other colors, e.g. blue, green, violet and black pigments or dyes.

The reflective particles can be any small particulate material which does not adversely affect the properties of the cover material. Preferably, the reflective material comprises at least one member selected from the group consisting of metal flake, iridescent glitter metallized film and colored polyester foil. The reflective particles preferably have faces which have an individual reflectance of over 75%, more preferably at least 95%, and most preferably 99–100%. For example, flat particles with two opposite faces can be used.

The maximum particle size of the reflective particles should be smaller than the thickness of the cover, and preferably is very small. The particle size preferably is 0.1 mm–1.0 mm more preferably 0.2 mm–0.8 mm, and most preferably 0.25 mm–0.5 mm. The quantity of reflective particles may vary widely, as it will depend upon the desired effect and is best determined experimentally. In general, an aesthetically pleasing reflective appearance can be obtained by using about 0.1–10, or more preferably 1–4 parts by weight reflective particles based upon 100 parts by weight of metallocene catalyzed polyolefin and rubber for producing a cover having a thickness of about 1.5–2.3 mm.

One of the advantages of the translucent covers of the present invention are that smaller amounts of dye, pigment, optical brightener and/or metal flake are needed than would be required if the covers were made of an opaque material. If an opaque cover were formed, it would be necessary to have complete color coverage on the outer surface of the cover. However, in accordance with the present invention pigment, dye and reflective particles which are well beneath the outer surface, as well as the carcass or wound bladder, contribute to the high visibility of the cover.

The game ball of the present invention can be made in the following manner. The central inflated portion can be formed using a conventional technique with the exception that the central bladder or carcass preferably contains white instead of black pigment. The bladder includes a valve for inflating the ball. After reinforcing fibers are wound around the bladder (if a bladder is used), the cover material containing metallocene catalyzed polyolefin is blended with an appropriate quantity of fluorescent dye, fluorescent pigment, reflective particles and/or optical brightener, and additives such as co-agents and reinforcing agents, if desired, using conventional rubber mixing equipment such as an open mill or internal mixer. If peroxide is to be used for crosslinking, the peroxide is blended with the other components of the cover material. When a peroxide is used, the metallocene catalyzed polyolefin-containing cover material is either (1) molded directly around the inflated portion by vacuum-molding, followed by hot curing at a temperature-time combination in the range of between about 140° C. for about 20 minutes or 160° C. for about 5 minutes, or more typically 150° C. for about 7 minutes, followed by at least 2 minutes of cold water, or (2) 8 panels of the cover material containing metallocene catalyzed polyolefin are die cut to size, molded around the wound bladder and cured under the same hot and cold conditions described in (1) above. It is expected that curing could be radiation-induced, thereby rendering the use of peroxide unnecessary.

Having generally described the invention, the following examples are included for purposes of illustration so that the invention may be more readily understood and are in no way intended to limit the scope of the invention unless otherwise specifically indicated.

EXAMPLE 1

A basketball was made having a central inflated portion comprising a whitish bromo butyl/natural rubber bladder wound with whitish nylon, having the reflectance shown in FIG. 1. The reflectance of the central inflated portion was relatively high, i.e. 40–75% throughout the visible spectrum because of its off-white color, and therefore the central inflated portion reflected substantial quantities of light throughout the range of visible wavelengths. Reflectance of the central inflated portion, and of the covered basketballs described below, was measured in accordance with ASTM E-313-73.

A cover having a thickness of 1.9 mm with a pebbled outer surface was molded over the central inflated portion as eight separate panels of the same color. The cover had the composition shown in Table 1, and the covered ball was cured for 7 minutes at 150° C.

TABLE 1

COVER COMPOSITION

| Component | Parts by Weight |
|---|---|
| Low viscosity EPDM[1] | 80 |
| Fast curing EPDM[2] | 20 |
| reinforcing agent[3] | 15 |
| coagent to improve physical properties of EPDM[4] | 6 |
| coagent to improve strength of bonds between EPDM and fillers[5] | 0.6 |
| peroxide[6] | 3.0 |
| orange fluorescent coloring[7] | 2.0 |
| | 126.6 |

[1]Nordel EPDM 1320, available from DuPont Far East, Inc., Suite 601 - 6th Floor., World Trade Center, 1 Maritime Square, Singapore 0409
[2]Nordel EPDM 1660, available from DuPont Far East, Inc., Suite 601 - 6th Floor., World Trade Center, 1 Maritime Square, Singapore 0409
[3]HiSil 233, sold by PPG Industries, Inc., One PPG Place, Pittsburgh, PA 15272
[4]SR-350, available from Sartomer Company, Inc., 202 Thomson Road #15-01A, United Square, Singapore 1130
[5]A-J72, available from Union Carbide Asia Pacific, Inc., 22/F Treasury Building, 8 Shenton Way, Singapore 0106
[6]Varox 231, sold by R. T. Vanderbuilt Co., Inc., 30 Winfield Street, P.O. Box 5150, Norwalk, CT 06856
[7]Day-Glo Color Corp., 4515 St Clair Avenue, Cleveland, OH 44103

The above-described composition resulted in a fluorescent orange basketball with a translucent fluorescent orange cover. After customary black lines were painted on the basketball, the reflectance of a colored panel of the basketball was measured over a range of 400–700 nm, and was compared to the reflectance of a panel of a standard orange rubber basketball with a cover made from natural and synthetic rubber which was sulfur cured. As indicated on FIG. 2, the fluorescent orange basketball exhibited a reflectance of as high as 150% at about 620 nm, and had a high reflectance in the orange spectrum, i.e. including the range from about 597–622 nm, and even up to about 660 nm. The fluorescent coloring resulted in a reflectance greater than 100% because the fluorescent material was able to absorb energy in the ultraviolet region and emit fluorescence in visible region. Thus, this ball is substantially more visible under low-light and daylight conditions than the standard orange rubber basketball, which has a maximum reflectance of only about 63%. The reflectance of the fluorescent ball was more than twice the reflectance of a non-fluorescent ball of generally the same color.

EXAMPLE 2

Figure 3:
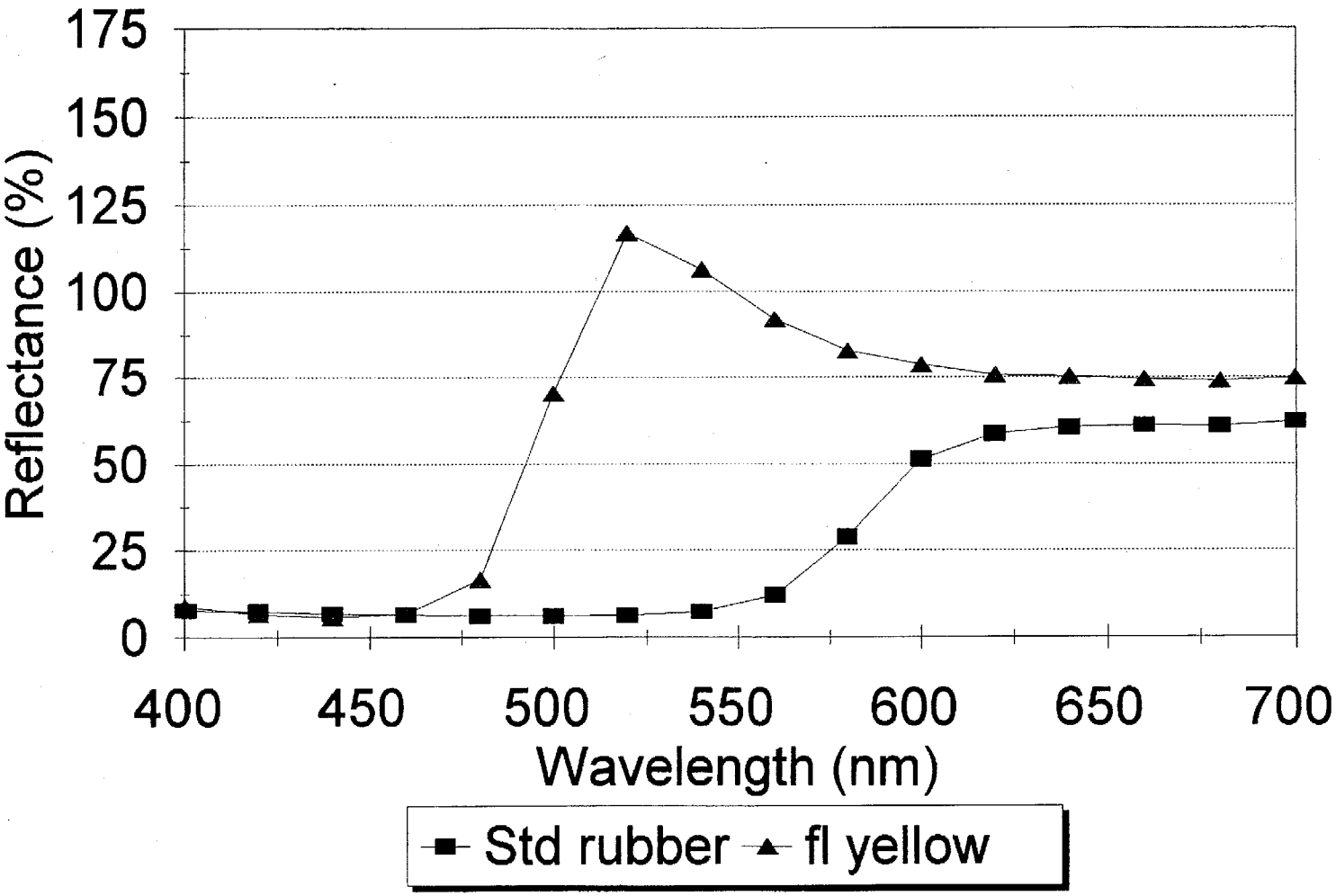
FIG. 3 is a graph showing the reflectance of a standard orange basketball and the fluorescent yellow basketball of Example 2.

A basketball was formed according to the same process as is described in Example 1 above, with the exception that the orange fluorescent coloring was replaced by 2 parts by weight of yellow fluorescent coloring which was obtained from Day Glo Color Corp., 4515 St. Clair Ave., Cleveland, Ohio 44103. The reflectance of the resulting basketball was compared with the reflectance of the same standard orange rubber basketball as was used for comparison purposes in Example 1, and the results are shown on FIG. 3. As shown in FIG. 3, the fluorescent yellow cover had a reflectance of about 120% at about 520 nm. Thus, the yellow fluorescent basketball has substantially higher visibility than a standard orange rubber basketball.

EXAMPLE 3

Figure 4:
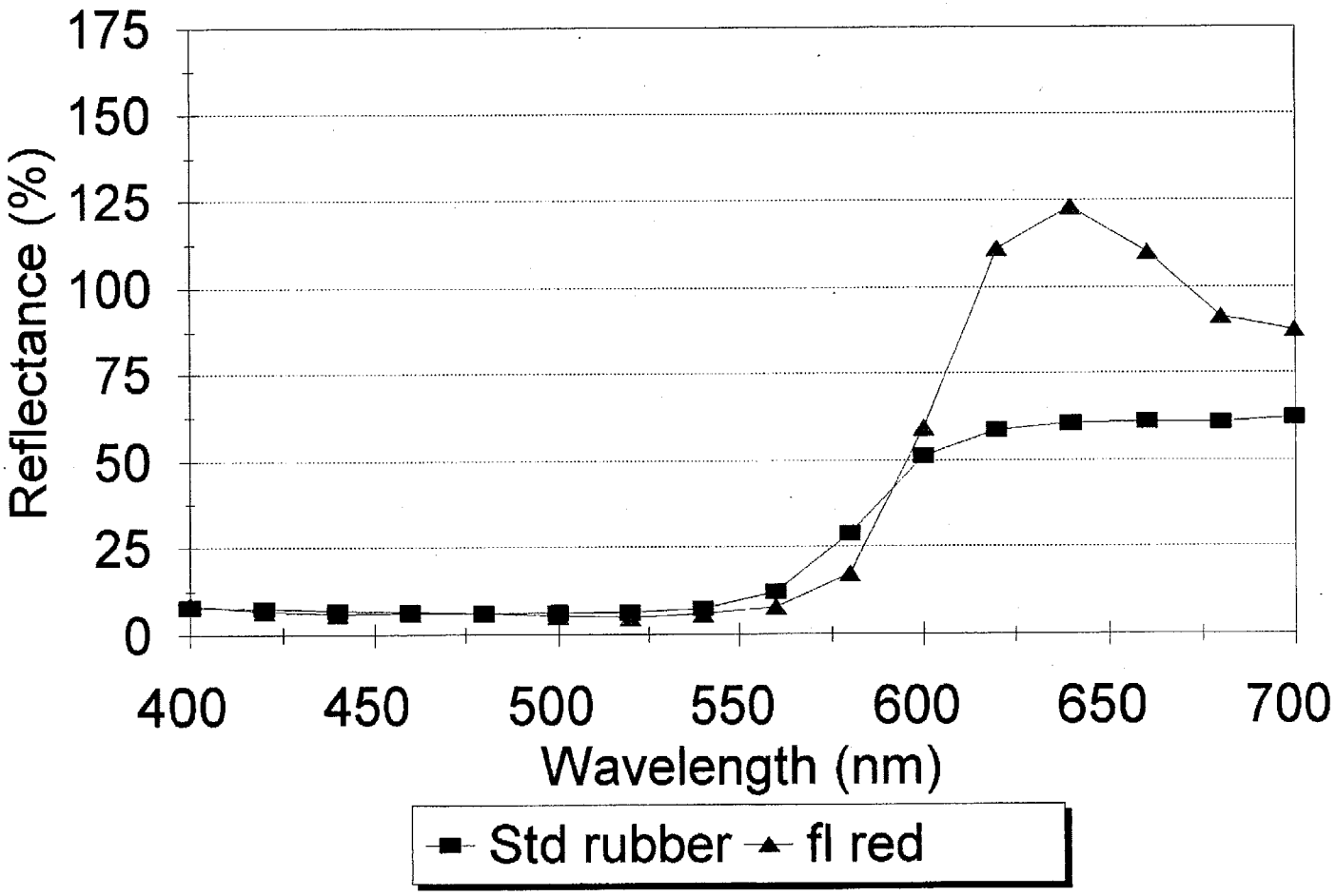
FIG. 4 is a graph showing the reflectance of a standard orange basketball and the fluorescent red basketball of Example 3.

A basketball was formed by the process described in Example 1 with the exception that the orange fluorescent coloring was replaced by 1.5 parts by weight of red fluorescent coloring which was obtained from Day-Glo Color Corp., 4515 St. Clair Ave., Cleveland, Ohio 44103 and was sold as Rocket Red GT-13. The reflectance of the resulting basketball was measured and was compared with the reflectance of a standard orange rubber basketball in FIG. 4. As shown in FIG. 4, the fluorescent red basketball had a reflectance of 125% at about 640 nm, which is substantially higher than the maximum reflectance of the standard basketball.

EXAMPLE 4

Figure 5:
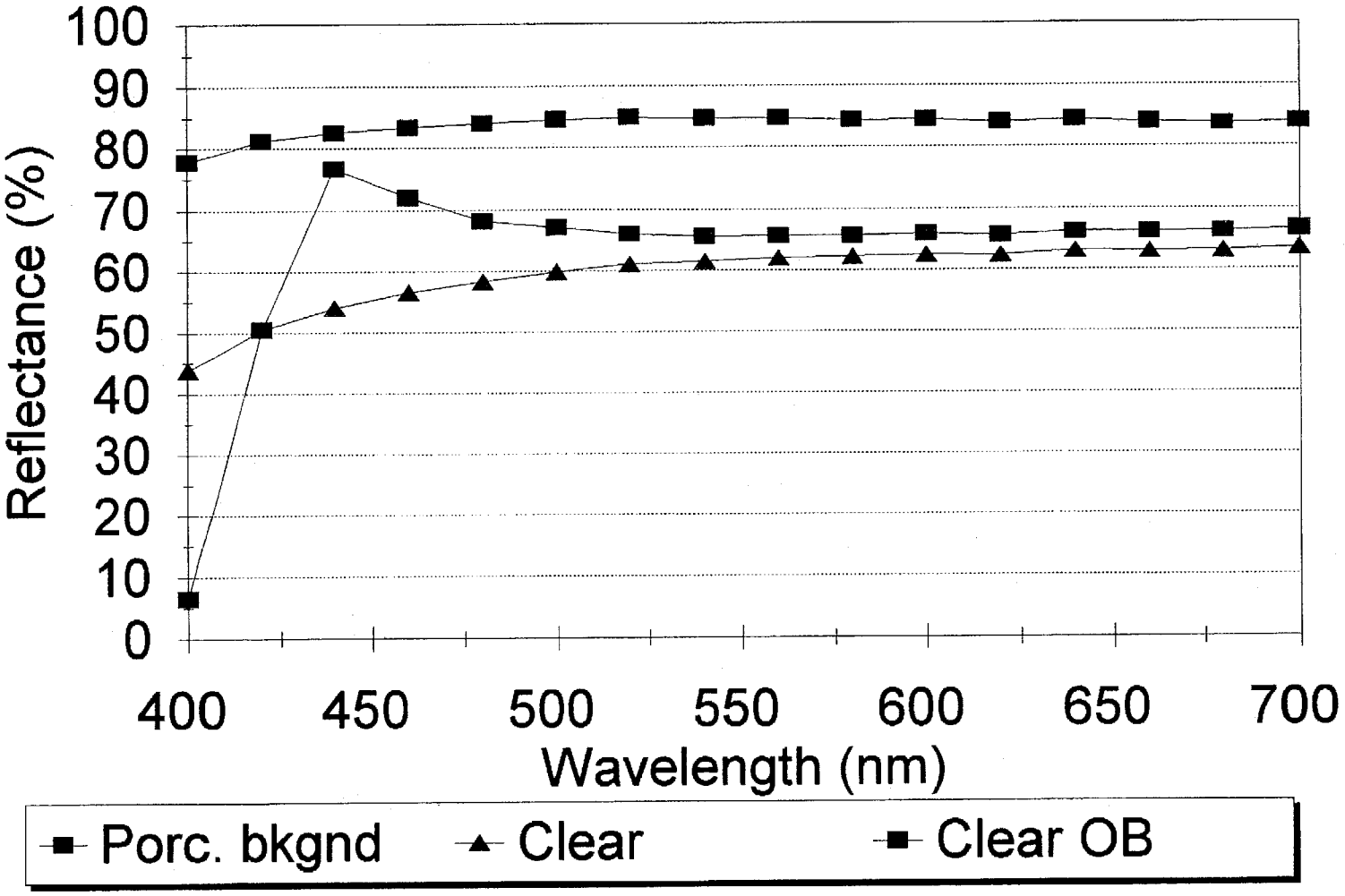
FIG. 5 is a graph showing the reflectance of (a) a basketball having a clear cover without optical brightener, (b) a basketball having a clear cover containing optical brightener, and (c) the porcelain background upon which the two clear covers were placed in order to obtain reflectance data.

A basketball was formed from the process described in Example 1 with the exception that the orange fluorescent coloring was replaced by 0.1 parts by weight of optical brightener known as Uvitex OB, which was obtained from Ciba-Geigy, Additives Division, Seven Skyline Drive, Hawthorne, N.Y. 10532-2188. A sample of the basketball cover material was obtained and placed on a porcelain background, and its reflectance was measured. The reflectance of the sample was compared to the reflectance of a sample of a clear basketball cover material which was formed from a cover having a composition which did not contain optical brightener but was otherwise identical, and which was placed on the same porcelain background. The reflectance of the porcelain itself also was determined. As shown in FIG. 5, the optical brightener-containing cover material, when on a porcelain background, had a reflectance of over 75–85% in the visible spectrum. The reflectance of the clear cover material which did not contain optical brightener was about 43–62%. The difference in reflectance between the cover containing optical brightener and the cover which did not contain optical brightener was about 20–30%.

EXAMPLE 5

A basketball was formed according to the process of Example 1 except that the orange fluorescent coloring was replaced by 1.0 parts by weight blue fluorescent coloring sold as Horizon Blue T-19 by Day-Glo Color Corp. Additionally, 0.50 parts by weight of flat, square metal flakes measuring 0.008" by 0.008" sold as Alpha Jewels by Meadowbrook Inventions, Inc., P.O. Box 360, Bernardsville, N.J. 07924 were added to the cover material. The resulting ball had a glittery appearance in which light reflected off the reflective particles in a mirror-like manner, thus enhancing the visibility of the ball.

EXAMPLE 6

The fluorescent yellow, orange and red balls obtained in Examples 1–3 and the conventional orange control ball which was used as a basis for comparison in Examples 1–3 were taken outside at dusk and were observed at distances frown 5 feet to 150 feet. The fluorescent yellow ball was the brightest, followed by the fluorescent orange ball, the fluorescent red ball, and, finally, the conventional orange ball. At one point just before dark, the three fluorescent balls were visible from about 30–50 feet away while the control ball was not visible.

Figure 2:
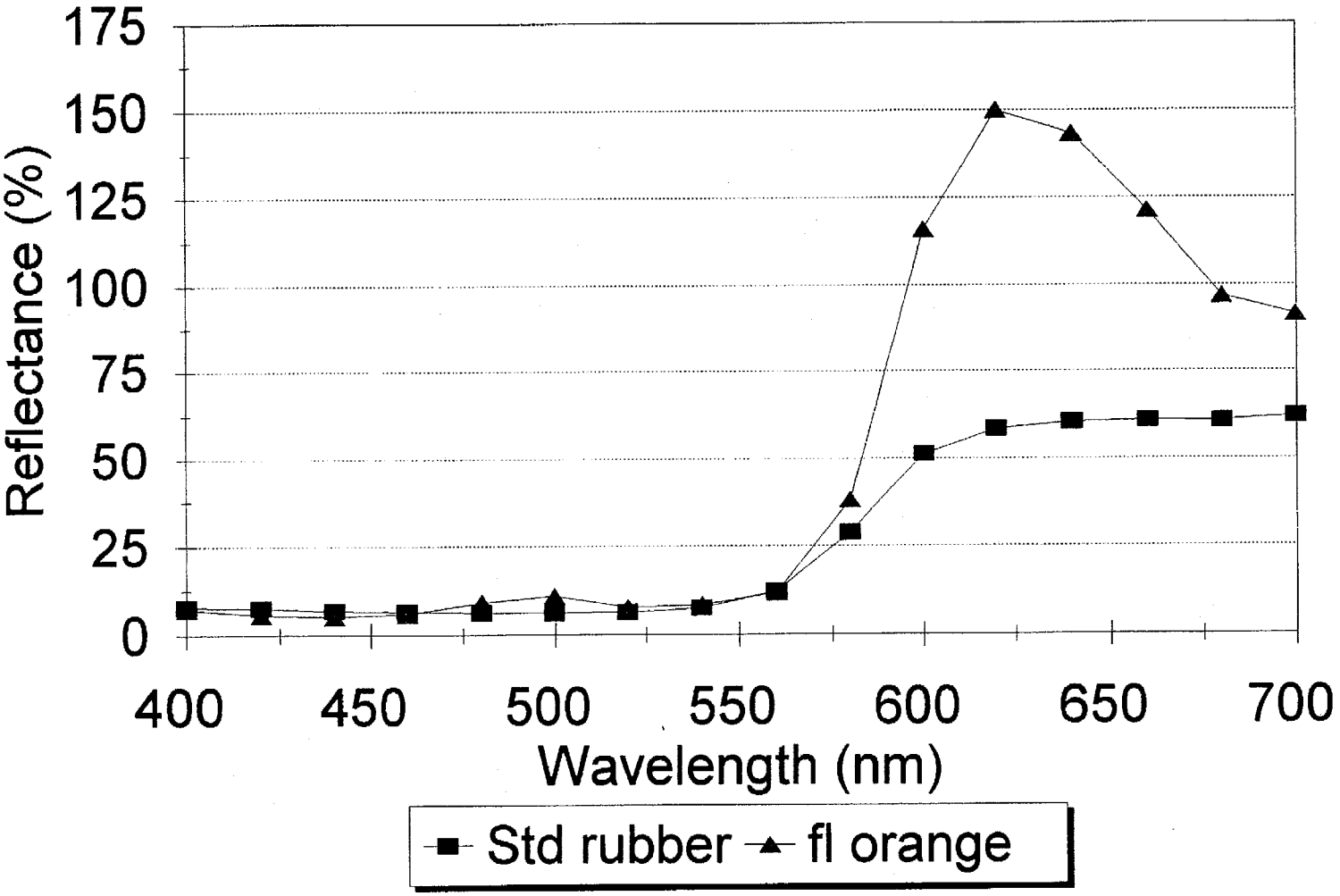
FIG. 2 is a graph showing the reflectance of a standard orange basketball and the fluorescent orange basketball of Example 1.

The results of this test are consistent with the reflectance measurements which are shown on FIGS. 1–3. The maximum reflectance of the fluorescent yellow ball was in the 500–550 nm range, while the maximum reflectance of the fluorescent orange and red balls was in the 600–650 nm range. The human eye is more sensitive to light in the 500–550 nm range than in the 600–650 nm range. The 1–12% greater reflectance of the standard orange ball as compared to the fluorescent red ball in the range of 500–600 nm is deemed insubstantial in view of the 10–60% greater reflectance of the fluorescent red ball as compared to the standard orange ball in the range of 600–700 nm.

EXAMPLE 7

A panel of a basketball cover material having the composition shown below in Table 2 and a thickness of about 1.9 mm was formed. The panel was cured at 310°–320° F. using steam for 20 minutes (the panel was at room temperature just prior to application of steam), followed by a 15 minute cooling stage using cooling water.

TABLE 2

COVER COMPOSITION

| Component | Parts by Weight |
|---|---|
| metallocene catalyzed polyolefin[1] | 100 |
| red fluorescent coloring[2] | 0.05 |
| peroxide[3] | 3.0 |

[1]EXACT ™ 4049, Exxon Chemical Company (Irving, TX)
[2]Lumogen F Red 300, BASF, Parsippany NJ 07054
[3]Varox 231, sold by R. T. Vanderbuilt Co., Inc., 30 Winfield Street, P.O. Box 5150, Norwalk, CT 06856

Figure 6:
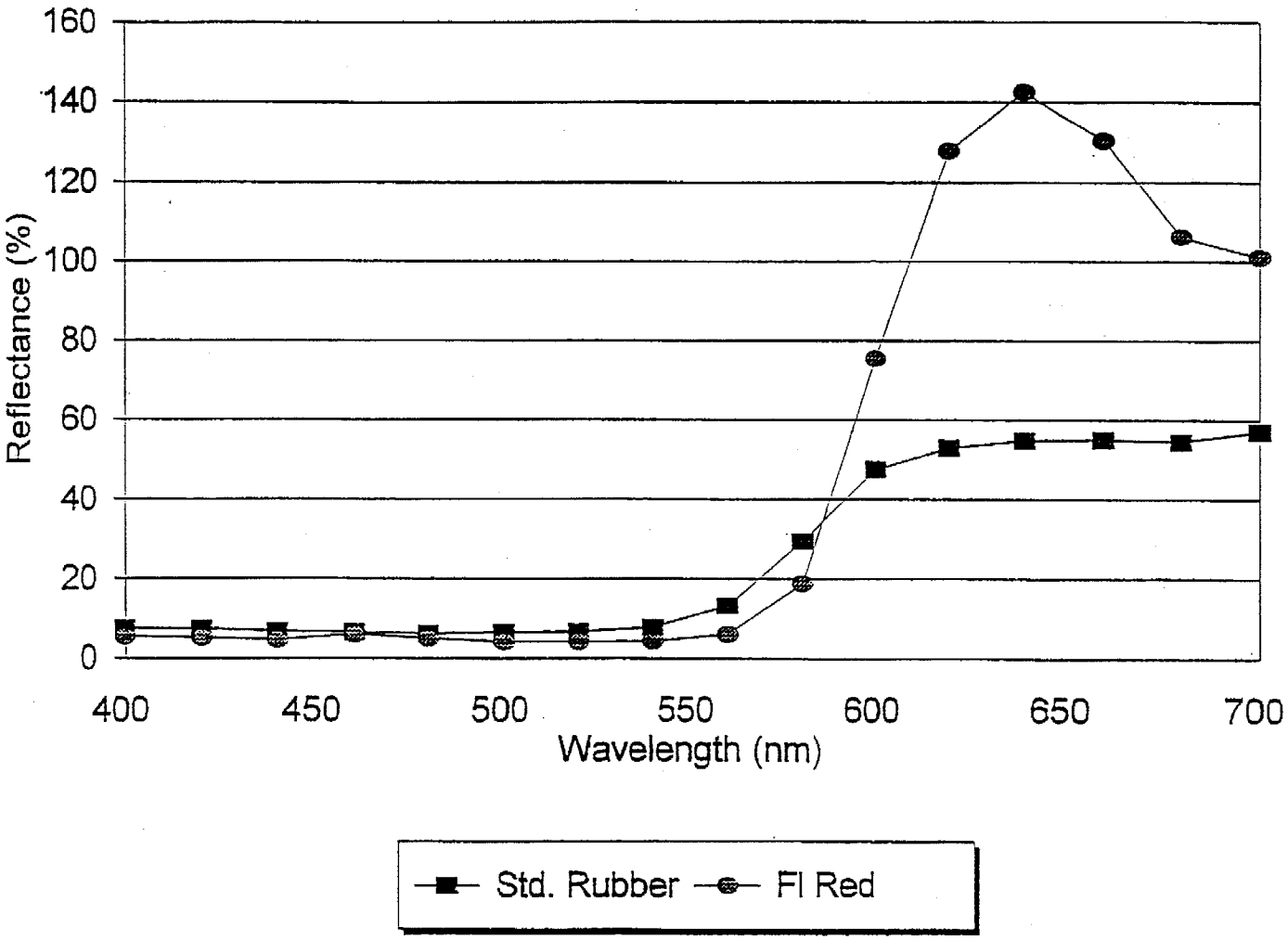
FIG. 6 is a graph showing the reflectance of the fluorescent red basketball of Example 7 as compared to a standard orange basketball.

The above-described composition resulted in a fluorescent red basketball cover material. The reflectance of a panel of the cover material was measured over a range of 400–700 nm when the material was placed on a the background, and was compared to the reflectance of a panel of a standard orange rubber basketball with a cover made from natural and synthetic rubber which was sulfur cured. As indicated in FIG. 6, the fluorescent red basketball cover material exhibited a reflectance of as high as 140% at about 640 nm, and had a high reflectance in the red spectrum, i.e. including the range from about 610–675 nm. The fluorescent coloring resulted in a reflectance greater than 100% because the fluorescent material was able to absorb energy in the ultraviolet region and emit fluorescence in the visible region. Thus, this cover material is substantially more visible under low-light and daylight conditions than the cover of a standard orange rubber basketball, which has a maximum reflectance of only about 60%.

EXAMPLE 8

A basketball cover panel was formed according to the process of Example 7 except that the red fluorescent coloring was replaced by 6 parts by weight of #310 Crystalina, an iridescent metal flake from Meadowbrook Inventions, N.J. The resulting panel had a glittery appearance in which light was reflected off of the reflective particles in a mirror-like manner, thereby enhancing the visibility of the ball.

EXAMPLE 9

A basketball cover panel was formed according to the process of Example 7 except that no red fluorescent coloring was used. The cured cover material had a Shore A hardness of 75. When placed on a the background which itself had a reflectance of 84%, a yellowness of 2.81 and a whiteness of 73.48, the cover exhibited a reflectance of 64.39% at 400–700 nm, a yellowness of 5.42 and a whiteness of 51.08. For the data in this application, reflectance and whiteness measurements were made according to ASTM E-313-73 and yellowness index tests were conducted in accordance with ASTM D-1925-70.

Comparative Example 1

A basketball cover panel was formed using the cover formulation of Example 1 except that no fluorescent coloring was used. The cover was cured using the conditions of Example 7 except that steam was used for 15 minutes. The cured cover material had a Shore A hardness of 65. When placed on a the background which itself had a reflectance of 84%, a yellowness of 2.81 and a whiteness of 73.48, the cover exhibited a reflectance of 58.81% at a wavelength between 400–700 nm, a yellowness of 12.12 and a whiteness of 33.19. Thus, this cover panel had somewhat lower visibility than the cover of Example 9.

What is claimed is:

1. A game ball, comprising:

a central inflated portion, and a cover formed over said central inflated portion, said cover being formed frown a cover material comprising a crosslinked metallocene catalyzed polyolefin, said cover material including at least one visibility enhancing agent selected from the group consisting of reflective particles having faces with a reflectance of at least 75% and a tinting agent which imparts to at least a portion of said game ball a reflectance of at least 75% in a part of the visible spectrum.

2. A game ball according to claim 1, wherein the cover material comprises a tinting agent which includes at least one member selected from the group consisting of fluorescent dyes, fluorescent pigments, and optical brighteners.

3. A game ball according to claim 1, wherein said cover material further comprises a member selected from the group consisting of a terpolymer elastomer made from ethylene propylene diene monomer, ethylene propylene rubber, natural rubber, and a blend of a terpolymer elastomer made from ethylene propylene diene monomer with at least one of polyisoprene rubber and polybutadiene rubber.

4. A game ball according to claim 3, wherein the cover material comprises a tinting agent which includes about 0.01–2.0 parts by weight of an optical brightener based upon 100 total parts by weight of metallocene catalyzed polyolefin and robber.

5. A game ball according to claim 3, wherein the cover material comprises a tinting agent which includes about 0.1–5.0 parts by weight of a fluorescent pigment based upon 100 total parts by weight of metallocene catalyzed polyolefin and rubber.

6. A game ball according to claim 3, wherein the cover material comprises a tinting agent which includes about 0.01–2.0 parts by weight of a fluorescent dye based upon 100 total parts by weight of metallocene catalyzed polyolefin and rubber.

7. A game ball according to claim 6, wherein said ball further includes a clear finish coating over said cover.

8. A game ball according to claim 1, wherein said central inflated portion has an outer surface with a reflectance of at least about 40% in a part of the visible spectrum.

9. A game ball according to claim 1, wherein said cover material includes highly reflective particles with a maximum particle size which is smaller than the thickness of said cover.

10. A game ball according to claim 1, wherein said ball is a basketball.

11. A game ball according to claim 1, wherein said central inflated portion is partially visible through said cover.

12. A game ball according to claim 1, wherein at least a portion of said game ball has a reflectance of at least 100% in a part of the visible spectrum.

13. A game ball according to claim 1, wherein the cover material comprises reflective particles which include at least one member selected from the group consisting of metal flake, iridescent glitter, metallized film, and colored polyester foil.

14. A game ball according to claim 3, wherein said cover material contains about 0.1–10 parts by weight of reflective particles based upon 100 total parts by weight of metallocene catalyzed polyolefin and rubber.

15. A game ball according to claim 14, wherein said reflective particles have a reflectance of at least 95%.

16. A game ball according to claim 2, wherein the cover material contains at least 10 wt % metallocene catalyzed polyolefin.

17. A game ball according to claim 12, wherein the cover material contains at least 10 wt % metallocene catalyzed polyolefin.

18. A game ball, comprising:

a central inflated portion, and a cover formed over said central inflated portion, said cover being formed from a cover material comprising at least 10 weight percent of a metallocene catalyzed polyolefin, said cover material including at least one visibility enhancing agent selected from the group consisting of reflective particles having faces with a reflectance of at least 75% and a tinting agent which imparts to at least a portion of said game ball a reflectance of at least 75% in a part of the visible spectrum.

19. A game ball according to claim 18, wherein the cover material comprises a tinting agent which includes at least one member selected from the group consisting of fluorescent dyes, fluorescent pigments, and optical brighteners.

20. A game ball according to claim 18, wherein said cover material further comprises a member selected from the group consisting of a terpolymer elastomer made from ethylene propylene diene monomer, ethylene propylene rubber, natural rubber, and a blend of a terpolymer elastomer made from ethylene propylene diene monomer with at least one of polyisoprene rubber and polybutadiene rubber.

21. A game ball according to claim 18, wherein said central inflated portion has an outer surface with a reflectance of at least about 40% in a part of the visible spectrum.

22. A game ball according to claim 18, wherein said ball is a basketball.

23. A game ball according to claim 19, wherein at least a portion of said game ball has a reflectance of at least 100% in a part of the visible spectrum.

* * * * *